United States Patent [19]

Kallman

[11] 4,168,544

[45] Sep. 25, 1979

[54] ARTICLE HOLDING SYSTEM

[75] Inventor: Robert A. Kallman, Brooklyn, N.Y.

[73] Assignee: Kallman Research Corporation, Weatoque, Conn.

[21] Appl. No.: 896,803

[22] Filed: Apr. 17, 1978

[51] Int. Cl.[2] ..... A41D 1/00

[52] U.S. Cl. ..... 2/94; 224/901

[58] Field of Search ..... 224/5 K, 5 R, 5 H, 5 V; 2/94, 249, 250, 268, 233, 246; 24/73 LG

[56] References Cited

U.S. PATENT DOCUMENTS 4,051,554 10/1977 Kallman ..... 2/94

*Primary Examiner*—Werner H. Schroeder
*Assistant Examiner*—Doris L. Troutman
*Attorney, Agent, or Firm*—Darby & Darby

[57] ABSTRACT

An article-holding system in which a first piece having fabric fastening means thereon is adapted for attachment to a base member and a flap having a piece of complementary fabric fastening means on opposite faces at its ends is attached to said first piece at an intermediate point. The flap is folded at an intermediate point in a storage condition so that the pieces of complementary type fabric fastening material at its ends can be fastened to said first piece whereby a flap which is longer than the first piece can be stored to occupy only the length of the first piece. When in article holding use, the flap is extended from the first piece, bent around the article and fastened to the first piece. A dual type system is also provided where the article can be held in one of two locations.

8 Claims, 8 Drawing Figures

ARTICLE HOLDING SYSTEM

In my prior U.S. Pat. Nos. 4,051,554 and 4,055,873, systems are disclosed for use on a garment or other place, such as a back-pack, bathing suit, etc. in which a first piece, having a first type of fabric fastening means thereon is attached to a base member. A flap having a type of fastening means thereon complementary to the first type is provided. An article to be held is located between the first piece and the flap when the two fastening means are engaged.

In the first of the aforesaid patents, a system is adapted for use on the shoulder of a garment, such as a jacket. There the first piece is formed in two parts, the first of these parts attached on the shoulder of a garment and the second part on the arm. One end of the flap is fastened to the garment adjacent the juncture of the shoulder and the arm and a piece of fabric fastening material with the complementary type fastening means is attached to the bottom of the flap. The flap has two positions of use. The first is a storage position in which its piece with complementary type fabric fastening means is fastened to the first piece on the shoulder so that the flap lies substantially flat on the shoulder. The second position is an article holding position in which the piece of complementary type fabric fastening means is attached to the first piece on the arm. The article is held between the flap and the arm.

The second of the aforesaid patents adds an extending portion to the flap to provide a secure holding arrangement for the article on the shoulder or base member to which the system is attached. The extending portion engages the article to be held and is wrapped at least part way around it.

The present invention relates to a modification and an improvement of the article holding systems. In accordance with the invention provision is made for extending the effective length of the flap to accommodate holding of larger articles and/or to accommodate a longer effective length for the flap for use on a garment having a narrow shoulder or on some other member where a longer effective flap length is desired.

In accordance with the invention a first elongated piece with a first type of fastening means thereon is provided for attachment to the base member, such as the shoulder of a garment. The flap is longer than the first piece and has one end attached to an intermediate position of said first piece. The flap is folded so that its length is substantially that of the first piece. A piece of complementary type fabric fastening means is attached to the side of the flap normally facing the first piece in the folded area and to the other side of the flap at its other end, which also normally faces said first piece. In a storage position, both the folded and the straight portions of the flap can be attached substantially flat to the first piece by both pieces of complementary type fabric fastening material. For article holding, the flap is disconnected from the first piece, the article placed adjacent the first piece and the flap moved toward or bent around and fastened to said first piece by one or both of the pieces of complementary type fabric fastening means. The use of the elongated flap permits holding of a larger article than otherwise could be accommodated. Also, when used on a garment, the flap can be extended over the arm and fastened to a piece of material with the first type of fastening means so that articles also can be held on the arm depending upon the choice of the user.

It is therefore an object of the present invention to provide an article holding system.

A further object is to provide an article holding system in which an extended holding flap can be used.

An additional object is to provide an article holding system to be used on the shoulder of an article of clothing, on which the length of the article hold flap is longer than the shoulder length.

A further object is to provide an article holding system for a garment having an extended flap which can be used either to hold an article on the shoulder or on the arm or on the chest.

Other objects and advantages of the present invention will become more apparent upon reference to the following specification and annexed drawings, in which.

Figure 1:
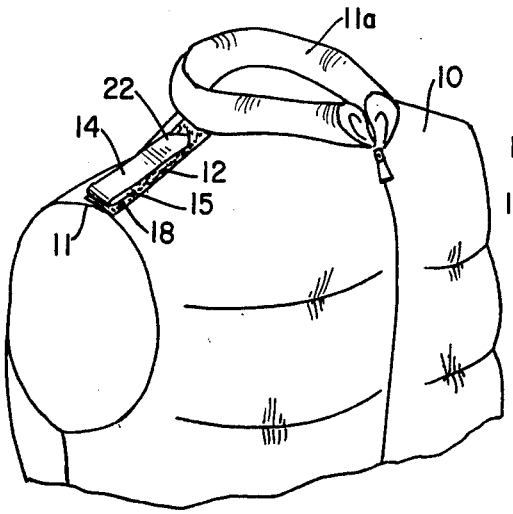
FIG. 1 is a perspective view showing a portion of the garment to which the fabric fastening system is to be used with the article holding flap shown in a storage position.
Figure 2:
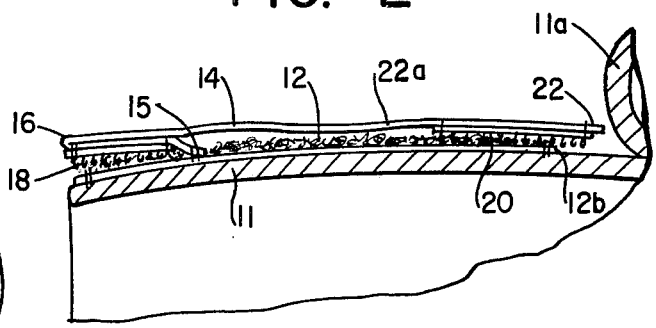
FIG. 2 is an elevational view of the system of FIG. 1 in cross-section, with the flap shown in a storage position.
Figure 3:
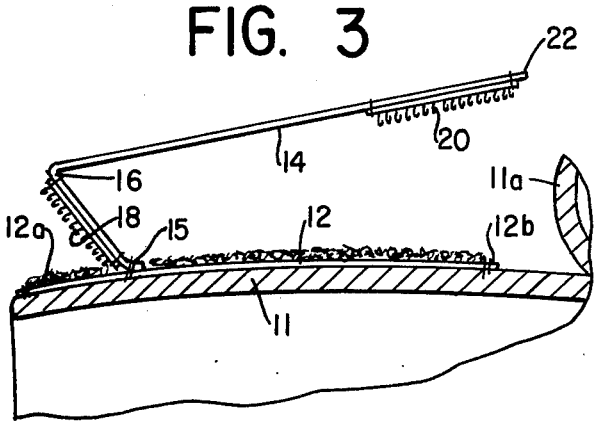
FIG. 3 is a view similar to FIG. 2 showing the flap in an unfastened condition.

Referring to the drawings, and in particular to FIGS. 1–3, the article holding system is shown for use on a garment such as a vest 10. As will be described hereinafter, the article holding system can also be attached to other members, for example, backpacks, the sides of garments such as bathing suits, fastened to the wall of a vehicle such as a boat, etc.

The article holding system includes a first elongated piece 12 which is attached to the base member, here shown as the shoulder 11 on the garment. Attachment is made, for example, by sewing, adhesive, heat sealing or any other suitable process. The first piece 12 has fabric fastening means of a first type thereon, for example, the loop part of a piece of fabric fastening material such as VELCRO. The first piece 12 extends from one end 12*a*, substantially at the end of the shoulder 11, to the other end 12*b*, at a point adjacent the garment neck 11*a*. It should be understood that the first piece can be made of two parts, one fastened adjacent the end of the shoulder 11 and arm and the other adjacent the neck of the garment.

The second part of the article holding system comprises a flap 14 which is longer than the piece 12 between its ends 12*a* and 12*b* and also usually longer than the shoulder 11. One end 15 of the flap is attached to either the piece 12 and/or to the underlying base 11 at a point intermediate the length of first piece 12. Usually the point of attachment is somewhat nearer to the end 12*a* of piece 12 than to end 12*b*, although the point of attachment can be selected as needed for a particular case. The fastening is accomplished, for example, by sewing the end 15 to piece 12 and/or the garment shoulder 11. The system can be made as an integral unit with the flap 14 already sewn to piece 12 and only piece 12 need be attached to the base member.

The flap 14 is bent at 16 and the free end 22 is folded back over in a direction toward the garment neck 11*a*. The length of folded section 22*a* of flap 14 between points 16 and 22 is substantially that of the first piece 12. A piece of fabric fastening material 18 which is complementary to the first type of fabric fastening means on piece 12, for example, VELCRO hooks, is fastened to the bent under part of the flap 14 in the area between its attached end 15 and the fold 16. A second piece of fabric fastening material 20, also of a type with fastening means complementary to those of 12, i.e. VELCRO hooks, is fastened on the undersurface of the end 22 of the flap remote from the bend 16. Thus, as seen, a piece of complementary type fabric fastening means is attached to each of the ends of flap 14 on opposite sides thereof.

As should be apparent from FIGS. 2 and 3, when unfolded the overall length of flap 14, that is, the length between its two ends 15 and 22 is substantially longer than the length of the first piece 12. The overall length of flap 14 can be made as long as desired and still have the length of first piece 12 when folded, by selecting the point of fastening end 15 along piece 12. That is, by fastening end 15 closer toward the garment neck 11*a*, the length of the piece between 15 and the bend is increased. For good securement of the flap in the storage position, the piece of fabric fastening material 18 should be located so that it is adjacent the end 12*a* of the first piece 12 when the strap is folded.

As shown in FIGS. 1 and 2, the system has a storage condition wherein the piece 18 of the complementary type fabric fastening material is pushed down to fasten to the area of first piece 12 between the point at which end 15 is fastened and a point adjacent the end 12*a* of the first piece 12. The free end 22 of the flap has its piece of complementary type fabric fastening material 20 fastened down onto the first piece 12 adjacent the garment neck 11*a*. Thus, the entire length of the flap 14 is completely stored on piece 12 even though it is longer than the piece.

Figure 4:
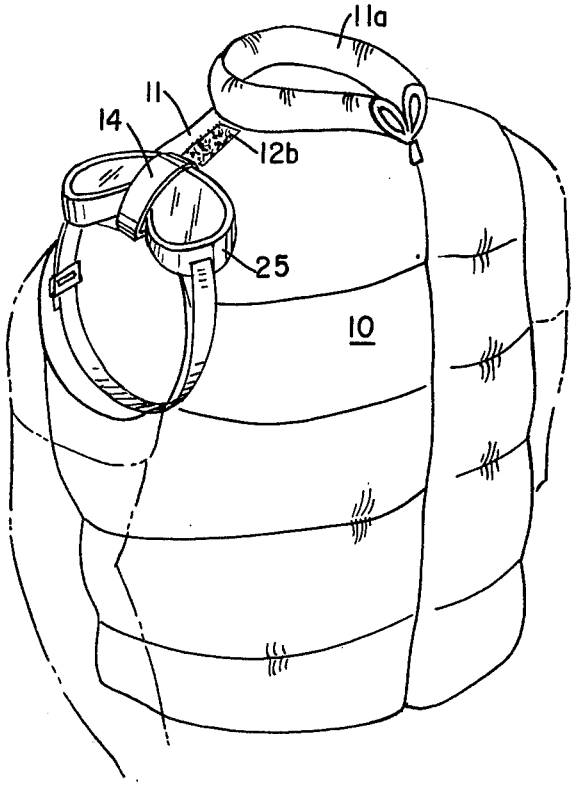
FIG. 4 is a perspective view showing the article holding system holding a pair of goggles.
Figure 5:
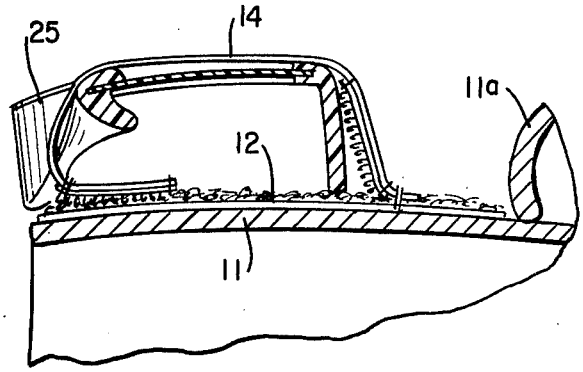
FIG. 5 is a cross-sectional view of FIG. 5 through the the goggles showing how they are held.

The usefulness of having a flap 14 whose length is longer than that of shoulder 11 is demonstrated in FIGS. 4 and 5 wherein a large (thick) pair of goggles are shown held between the underside of flap 14 and the shoulder 11. Due to their thickness, goggles 25 could not be securely held near the edge of the shoulder by a flap 14 whose length was only that of piece 12. Using the present fastening system, to hold the goggles it is only necessary to unfasten end 22 of flap 14 from piece 12 and also unfasten the first piece 18 of complementary fabric fastening material from the end area 12*a* of piece 12 (see FIG. 2). The goggles are then laid on piece 12 and under the flap 14 with the bridge of the goggles facing toward the arm. The flap 14 is then bent around the goggles over the nose bridge area, and the piece 20 of complementary type fabric fastening material on the end 22 of flap 14 is fastened to the end piece 12*a* making a secure holding engagement for the goggles. As shown in FIG. 4A, there is fastening engagement between the piece 18 of complementary type fabric fastening material and the piece 12 in the end area 12*a*. If the goggles were move higher up on the shoulder, this fastening area would decrease. Whether or not the fastening area exists is a function of the size of the article being held and/or its position with respect to end 12*a*.

Figure 6:
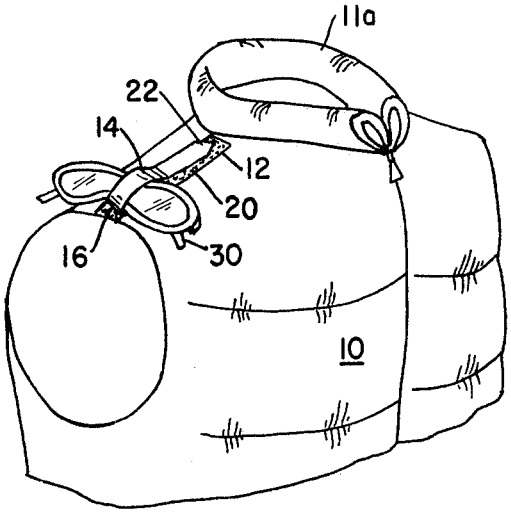
FIG. 6 is a view similar to FIG. 4 showing how a pair of spectacles are held.
Figure 7:
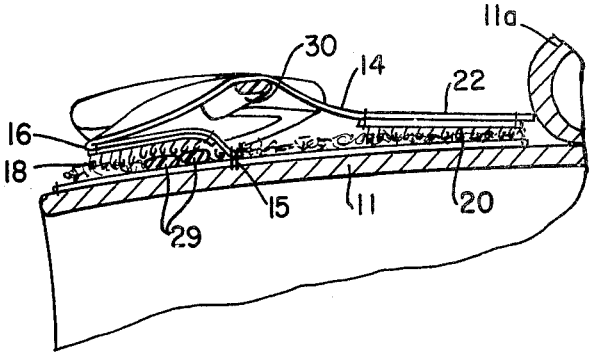
FIG. 7 is a cross-section through the spectacles as shown in FIG. 6.

FIGS. 6 and 7 show another type of article which is held by the system of FIGS. 1–5, here a pair of eyeglasses. In this case, the arms 29 of the glasses are folded in their storage position. The flap 14 is passed over the bridge 30 of the glasses and the arms 29 are stored under piece 18 of complementary type fabric fastening material. The second piece 20 of complementary type fabric fastening material is fastened down to piece 12 near end area 12*b* and the piece 18 is fastened down over arms 29 of the glasses to the first piece 12 in the end area 12*a*. Thus, the glasses are securely held.

Other articles also can be held by the system. For example, a key ring can be slipped over the flap and the ring would be held within the bend 16 of the flap. The strap of an article such as a camera or pocketbook also can be held in this way. A flashlight or hat can be held like the goggles in FIGS. 5 and 6, as well as rope, binoculars, pistol, camera or any object with the appropriate size strap.

Figure 8:
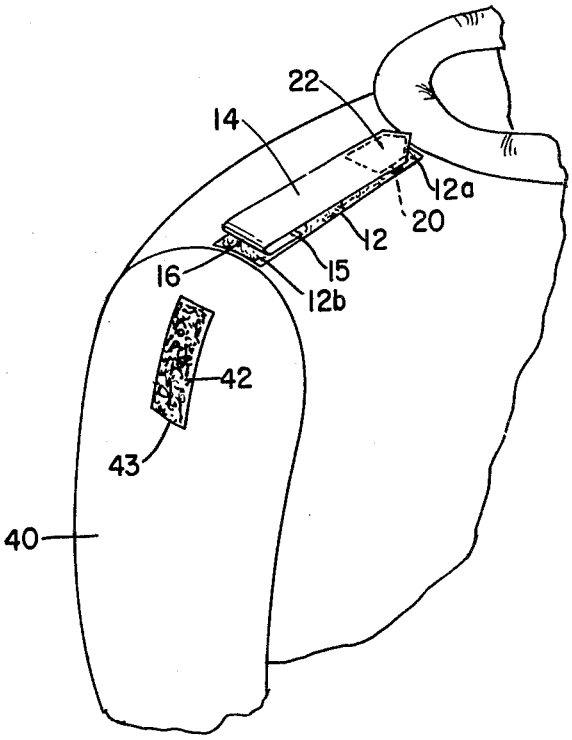
FIG. 8 shows a modification of the invention wherein the flap is adapted to be fastened on an arm portion of the garment.

FIG. 8 shows a further embodiment of the invention where the holding system is shown for use with a garment having a sleeve 40 and in which the system also has a dual function. The flap 14 and the first piece 12 are constructed as previously described. The difference here is that a piece of fabric fastening material 42 of the first type, that is, the same as 12, is attached to the garment arm 40, such as by sewing, heat-sealing, etc. Piece 42 can be either an extension of the first piece 12 or else a separate piece can be used, as shown. The distance from the end 43 of the piece 42 remote from the junction of the shoulder and arm of the garment to the junction is made somewhat less than the length of the part of the flap from bend 16 to end 22. With the arrangement of FIG. 1, an article now can be held either on the shoulder (as previously described) or on the arm 40. To do the latter, flap 14 is unfastened from the shoulder piece 12 and fully extended. It is then bent over and around the article to be held and the end 22 is bent under so that the piece 20 of complementary type fabric fastening material can be attached to the piece 42 on the arm. The piece 18 of complementary type fabric fastening material may remain fastened to the first piece 12, or as longer lengths are needed to encircle a large item, piece 18 separate from 12A providing necessary increased length.

It should be understood that the piece 42 need not be an extension of first piece 12. For example, a small piece of the complementary type fabric fastening material 42 can be attached to the arm 40 at a desired location where the attachment of flap 14 is to take place.

The article holding system of FIG. 8 can perform a dual function. That is, it can hold an article either on the arm or on the shoulder.

While the article holding system has been described with respect to its use on a particular type of garment, it should be understood that it should not be limited thereto. For example, the system such as shown in FIGS. 1–7 can be attached to a backpack or duffle bag, or other piece of luggage by fastening the piece 12 thereon. Here the end 15 of flap 14 can be attached either directly to piece 12 or to the underlying base. The system will then function in the manner described with respect to FIGS. 1 through 7. This system can also be attached to other types of members, e.g. the wall of a boat, fabric of an aircraft interior, etc. The system also can be used on other types of garments, e.g. the leg or front of a pair of bathing or tennis shorts.

What is claimed is:

1. An article holding system comprising a first piece having fabric fastening means of a first type adapted for attachment to a base member, a flap attached to said first piece intermediate the ends of said first piece, said flap having a folded first portion between its point of attachment substantially to one end of said first piece and a second portion extending from the bend of the fold back toward and substantially to the other end of said first piece, a first means with fabric fastening means of a type complementary to said first type attached to said flap in the folded portion facing said first piece and a second means also with fabric fastening means of a type complementary to said first type attached to the area of said flap second portion also facing said first piece so that both said first and second fabric fastening means can be attached to the fabric fastening means of said first type with the flap stored generally flat.

2. An article holding system as in claim 1 wherein said first piece is a single elongated piece.

3. An article holding system as in claim 2 wherein said flap is attached to said piece to form an integral unit.

4. An article holding system as in claim 1 wherein said first piece is formed as two separate parts.

5. An article holding system as in claim 1 wherein said fabric fastening means on said first piece and on said flap comprises complementary hook and loop fastening means.

6. An article holding system as in claim 1 wherein said first piece is adapted for fastening to the shoulder of a garment, said flap when extended being longer than said shoulder.

7. An article holding system as in claim 1 further comprising a second piece having fabric fastening means of said first type adapted for attachment to said base member at a point remote from said first piece and adopted to receive said second means of complementary type fabric fastening means.

8. An article holding system as in claim 7 wherein said first piece with fabric fastening means of the first type is adapted for fastening to the shoulder of a garment and said second piece with fabric fastening means of the first type is adapted for fastening to the arm of the garment whereby said second means of said flap can be selectively attached to either of said first or second pieces with fabric fastening means of the first type.

* * * * *